United States Patent [19]

Ishizawa et al.

[11] Patent Number: 4,729,615

[45] Date of Patent: Mar. 8, 1988

[54] WARDROBE OR OTHER CONTAINER WITH FOLDING DOORS

[75] Inventors: Kenji Ishizawa, Kyoto; Chiyokazu Higashi, Saitama, both of Japan

[73] Assignees: Daiken Trade & Industry Co. Ltd., Toyama; Murakoshi Screw Mfg. Co. Ltd., Tokyo, both of Japan

[21] Appl. No.: 886,354

[22] Filed: Jul. 17, 1986

[30] Foreign Application Priority Data

Jul. 19, 1985 [JP] Japan ..... 60-159667

[51] Int. Cl.[4] ..... A47B 61/00

[52] U.S. Cl. ..... 312/324; 160/199; 160/206

[58] Field of Search ..... 166/199, 206; 312/324–327, 296, 138 R

[56] References Cited

U.S. PATENT DOCUMENTS

| | | | |
|---|---|---|---|
| 746,758 | 12/1903 | Stiggleman | 160/206 |
| 3,221,804 | 12/1965 | Rudnick | 160/206 |
| 3,403,954 | 10/1968 | Williams | 312/139 X |

*Primary Examiner*—Joseph Falk

*Attorney, Agent, or Firm*—Leydig, Voit & Mayer

[57] ABSTRACT

A container assembly has two door sections of a folding door which are coupled together by means of hinges provided at upper and lower positions on the rear surfaces of the mutually adjacent inner vertical edge portions of the doors so that the doors can be folded, by pivotal motion, with the thus hinge-coupled inner-edge portions thereof protruding outwardly from the body, thus exposing the front opening of the body. Upper and lower movement enabling means mounted to each door section are movable on upper and lower rails of the body opening closed by the folding door.

5 Claims, 6 Drawing Figures

WARDROBE OR OTHER CONTAINER WITH FOLDING DOORS

BACKGROUND OF THE INVENTION

1. FIELD OF THE INVENTION

The present invention relates to a container for example a wardrobe, a closet, a cupboard or the like which has a folding door.

2. SUMMARY OF THE PRIOR ART

In case of a conventional wardrobe or the like which is provided with a pair of foldably coupled doors effective to close the front opening of the main body thereof, an outer edge portion of one of the doors is pivotally supported on the main body, while runners provided in the upper and lower edge portions of the other door are slidably fitted in rails mounted on the upper and lower sides of the main body defining the front opening, so that, by pulling the pair of doors to one side thereof, they are opened.

In case of a container of the type just described the pair of doors can be opened only in one fixed direction, and therefore, the arrangement or combination of such containers are limited, and in addition, it is difficult to deposit and remove items from them particularly that portion of the main body which is located adjacent the pivotally supported portions of the doors.

One object of the present invention is to provide a container constructed so that a pair of folding doors can be opened from either the right or left-hand side thereof, in which case the opening/closing operation of the doors from either direction can be smoothly performed, and it is ensured that, when fully extended and aligned, the doors can be safely maintained in the closed condition.

SUMMARY OF THE INVENTION

According to the present invention there is provided a container assembly comprising means defining a main body with a front opening, and having upper and lower portions, an upper rail mounted on the said upper portion, a lower rail mounted on the said lower portion, a pair of door sections arranged to close said front opening, hinge means connecting said door sections at adjacent vertical edges thereof, upper movement-enabling means mounted to each of the door sections and movable on the upper rail, lower movement-enabling means mounted to each of the door sections and movable on the lower rail, the movement-enabling means and the hinge means being so arranged that the door sections can fold so that the door sections protrude outwardly of the front opening to enable access to the container, and stop means provided at each end of at least one of said rails, said stop means serving releasably to retain the corresponding said movement-enabling means.

DESCRIPTION OF THE PREFERRED EMBODIMENT

Figure 1:
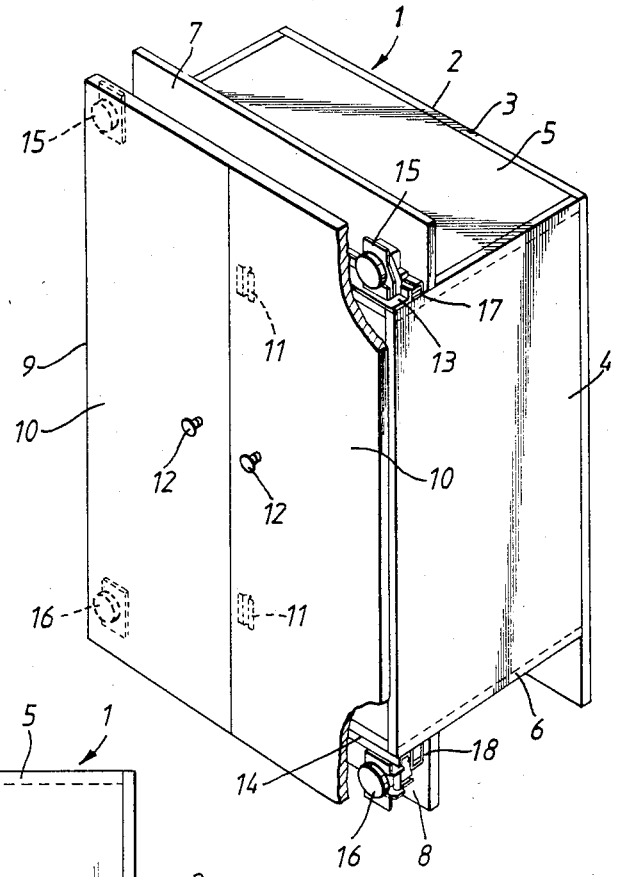
FIG. 1 is a partially cut-away, perspective view showing one embodiment of a container assembly according to the present invention.
Figure 2:
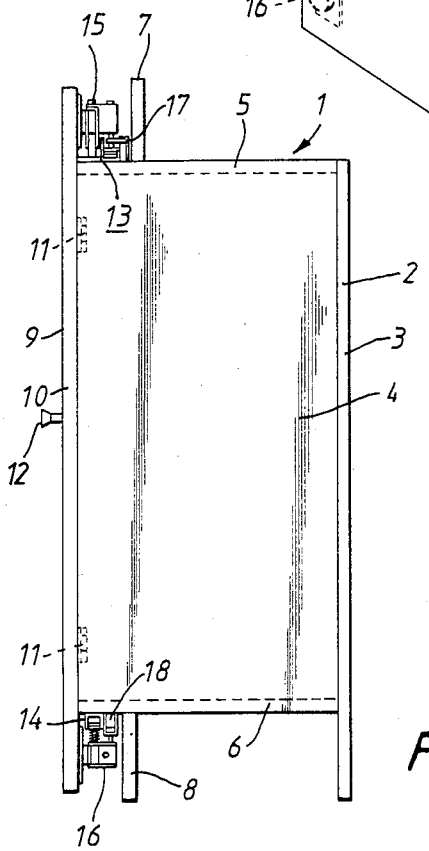
FIG. 2 is a side view of FIG. 1.

Referring to FIGS. 1 and 2, a container such as a wardrobe 1 comprises a box-like main body 2 with an open front. The body 2 comprises a rear panel 3, two side panels 4, a top panel 5, a bottom panel 6, and elongate reinforcing members 7 and 8 are provided at positions spaced rearwardly from and parallel to the front edges of the top and bottom panels 5 and 6.

For the front opening of the body 2 a folding door 9 is provided which comprises right-hand and left-hand door sections 10, which are coupled together by means of hinges 11 provided at upper and lower positions on the rear surfaces of the mutually adjacent inner vertical edge portions of the doors 10 so that the doors can be folded, by pivotal motion, with the thus hinge-coupled inner-edge portions thereof protruding outwardly from the body 2, thus exposing the front opening of the body 2. Door knobs 12 are provided on the front surfaces of the doors 10 at positions adjacent to the inner-vertical edges thereof.

Upper and lower rails 13 and 14 are disposed along the upper and lower side portions of the body 2 defining the front opening. Further, at upper and lower positions of the outer side edges of the rearwardly facing surfaces of the doors 10, upper and lower movement enabling means 15 and 16 are provided which are movably engaged with the upper and lower rails 13 and 14, respectively, and pivotally support the doors 10 so as to allow the doors 10 to be folded up, by pivotal movement, with the inner-edge portions thereof protruding outwardly from the body 2, thus exposing the front opening of the body 2.

At the respective ends of the upper and lower rails 13 and 14, stop means 17 and 18 are arranged releasably to retain the movement-enabling means 15 and 16, respectively.

The upper and lower rails 13 and 14, the means 15 and 16, and the upper and lower stop means 17 and 18 will now be described in more detail with reference to FIGS. 3 to 6.

The upper rail 13 is mounted on the front edge portion of the upper surface of the top panel 5 and comprises a front portion, in the form of a horizontal guide portion 21 and a rear portion, in the form of a vertical guide portion 22 which is approximately U-shaped in cross-section, the limbs being of unequal height.

The lower rail 14 is mounted along a front edge portion of the lower surface of the bottom panel 6 and comprises a guide portion 23 which is approximately of inverted-U-shape in cross-section.

The upper movement-enabling means 15 include support rollers 27 which are respectively supported by pins 26 passing through bearing plates 25 on both sides of the lower part of the front portion of a frame body 24, and horizontal rollers 30 (rotatable about a vertical axis) which each have a resilient annular member 29 surrounding the periphery thereof and are supported on vertical shafts 28 (FIG. 4) on both sides of the lower part of the rear portion of the frame body 24. The outer periphery of each of the vertical shafts 28, receives a bush 31 arranged to engage with the upper stop means 17. In the center portion of the frame body 24, a support frame 32 is fitted for movement up and down, and, in the support frame 32, an internally-screw-threaded body 33 is mounted, with which a rotary screw shaft 34 extending vertically in the front portion of the frame body 24 is engaged. At the rear portion of the support frame 32 in addition to the body 33, a vertical guide rod 35 extends through the rear portion of the frame body 24. A pair of links 36 is provided each pivotally mounted at one end thereof to the front portion of the support frame 32, and, to the other ends of the links 36, a mounting plate 37 is pivotally mounted in a recessed portion 38 thereof.

The mounting plate 37 of each upper movement-enabling means 15 is fixed to the door section 10 by mounting screws 39, the recessed portion 38 thereof being formed in the door section 10, the support rollers 27 being supported on the horizontal guide portion 21 of the upper rail 13, and the horizontal rollers 30 being engaged in the vertical guide portion 22.

The lower movement-enabling means 16 are each constructed as follows: In the front portion of a frame body 41, a movable frame 42 is provided for up and down movement. This movable frame 42 comprises guide rods 43 which are fitted into both side portions of the frame body 41 for movement up and down, connecting plates 44 and 45 which extend between the upper ends of the guide rods 43 and between the lower ends of the guide rods 43, an operating rod 46 which is coupled with the center portions of the upper and lower connecting plates 44 and 45, extending through the frame body 41, and a grip member 47 which is attached to a downwardly-projecting portion of the operating rod 46. Further, around those portions of the two guide rods 43 which extend between the upper surface of the frame body 41 and the lower surface of the upper connecting plate 44, helical springs 48 are mounted, respectively, so that the movable frame 42 is biased upwards.

Further, horizontal rollers 50 each having a resilient annular body 49 disposed around the periphery thereof are supported on the upper end portion of the guide rods 43. A support frame 51 is mounted in the center portion of the frame body 41, and, to the front end portion of the support frame 51, the one ends of a pair of links 52 are pivoted, while, to the other ends a mounting plate 53 is pivoted in a recess 54 thereof. In the upper part of the rear and center portion of the frame body 41, a shaft-like stop rod 55 is provided which acts as a locking body which is arranged to engage with the lower stop means 18.

The mounting plate 53 is secured to the door section 10 by mounting screws 56 in the recess 54 which lies within in the door section 10, and the horizontal rollers 50 are engaged in the guide portion 24 of the lower rail 14.

Figure 3:
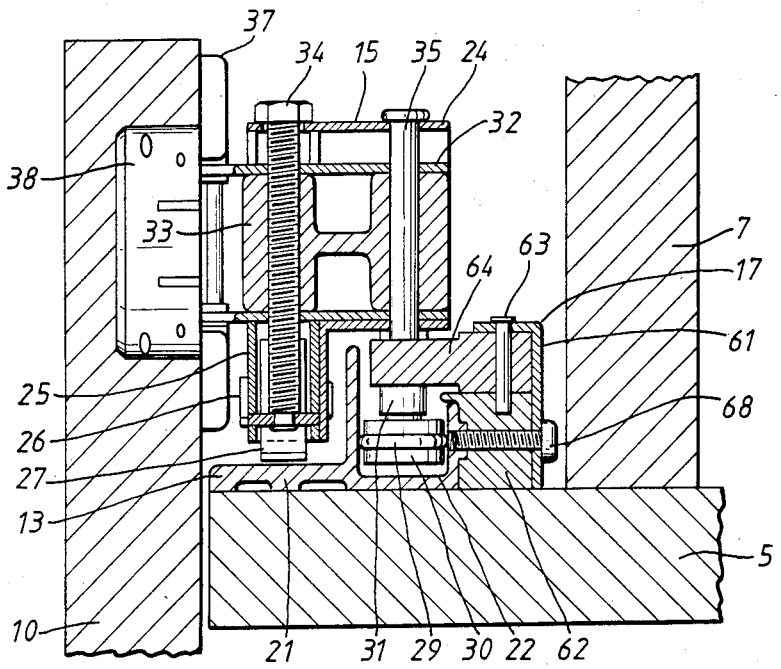
FIG. 3 is a sectional view of movement-enabling means shown in FIG. 2.
Figure 3:
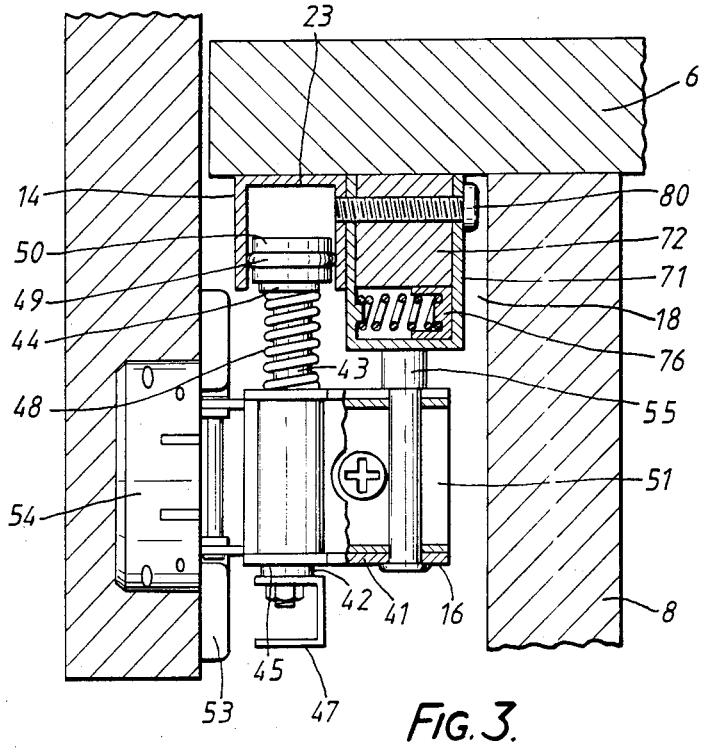
Figure 4:
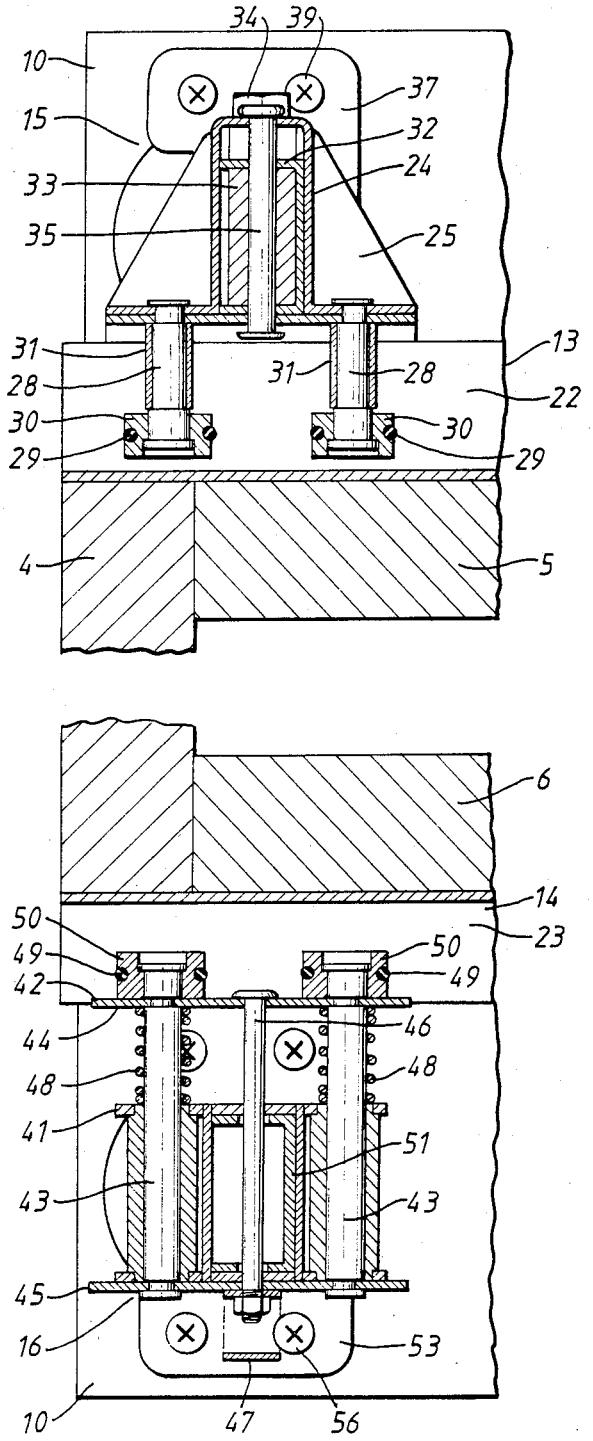
FIG. 4 is a back view of FIG. 3.
Figure 5:
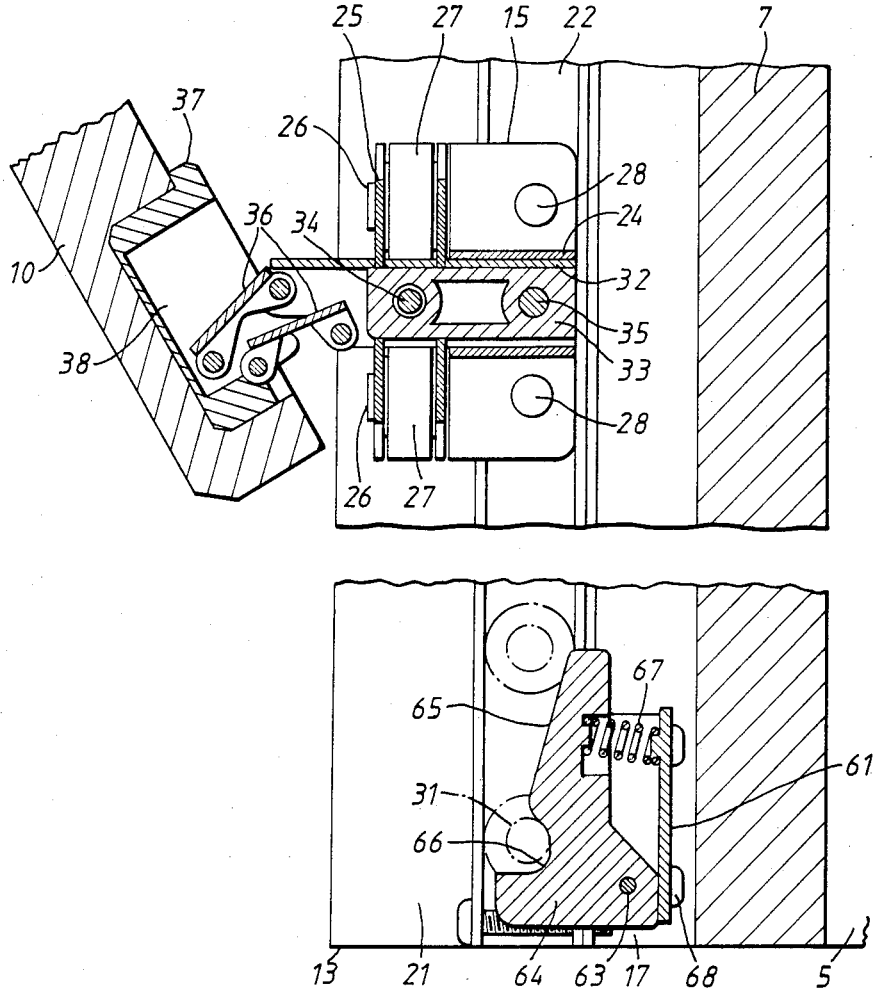
FIGS. 5 and 6 are cross-section of FIG. 3, respectively.

The upper stop means 17 includes an approximately inverted-L-shaped frame body 61 as best shown in FIGS. 3 and 5, and, in the inner lower portion of the frame body 61, a support block 62 is mounted. At one side of the frame body 61, a support pin 63 is mounted extending between the support block 62 and the upper portion of the frame body 61, and, in the upper inside portion of the frame body 61, the base portion of a stop member 64 is supported on the support pin 63 so as to be rotatable horizontally. The stop member 64 has a tapered guide portion 65 extending obliquely along the outer surface of the stop member 64 from its tip side, and further, a part-circular recess 66 is formed which continues to the guide portion 65. Between the frame body 61 and the leading end portion of the stop member 64, a helical spring 67 is so located that the stop member 64 is biased outwardly.

The frame body 61 is fixed, together with the support block 62, to the rear side wall surface of the upper rail 13 by means of several screws 68, in which case the stop member 64 is located within the guide portion 22 so that the bush 31 of the outer one of the vertical shafts 28 of the upper movement-enabling means 15 which are movable along the guide portion 22 can be engaged in the recess 66 of the stop member 64.

Figure 6:
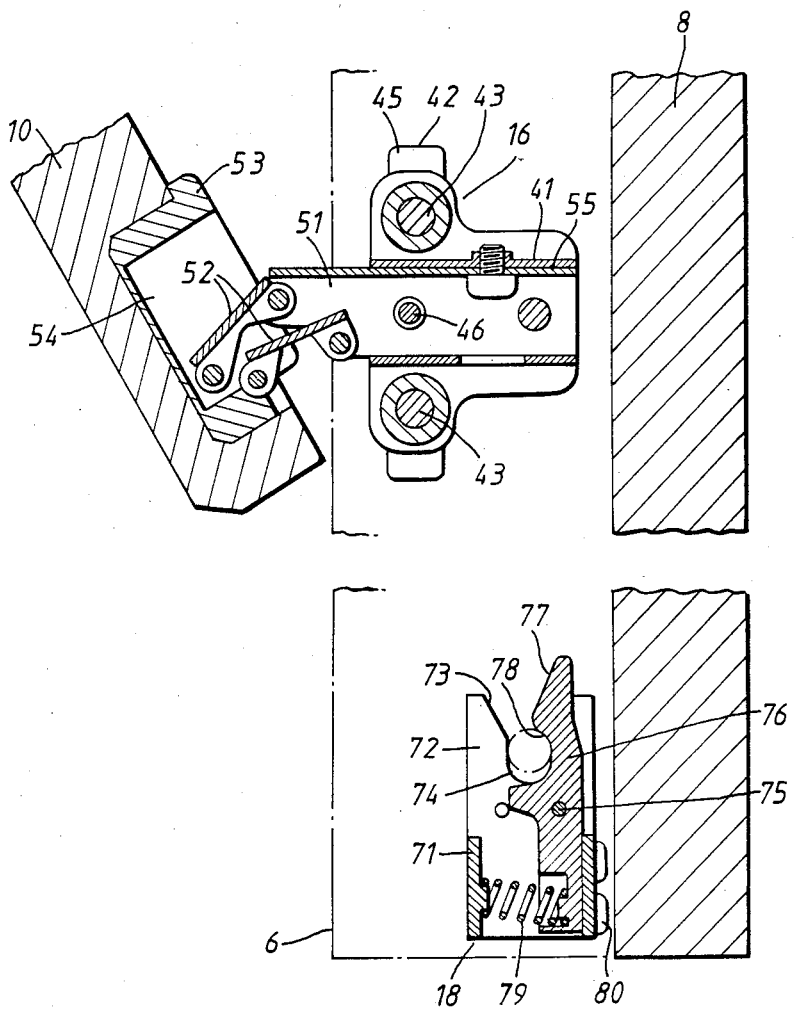

The lower stop means 18 has an approximately U-shaped frame body 71 as best shown in FIGS. 3 and 6 and, in the upper inside portion of the frame body 71, a support block 72 is located. In the support block 72, a recess 74 is formed continuing to a tapered guide portion 73 extending obliquely from the tip of the support block 72. Further, in the intermediate portion of the support block 72, a support pin 75 is mounted extending between the underside portion of the frame body 71 and the support block 72, so that the intermediate portion of a stop member 76 made of a synthetic resin is supported on the support pin 75 so as to allow the stop member 76 to be rotated horizontally. The stop body 76 has a tapered guide portion 77 extending obliquely from the tip thereof along the outer side surface thereof, and a part-circular recess 78 is formed continuing to this guide portion 77. Furthermore, between the outer leg portion of the frame body 71 and the base portion of the stop member 76, a helical spring 79 is provided, so that the tip of the stop member 76 is biased outwards.

The frame body 71 is fixed, together with the support block 72, to the rear side wall surface of the lower rail 14 by means of screws 80, in which case the stop member 76 is located within the track portion along which the stop rod 55 of the lower movement-enabling means 16 is moved, so that the stop rod 55 can be brought into the recess 78 of the stop member 76.

The pair of doors 10 are mounted on the body 2 as follows. The upper movement-enabling means 15 of the respective doors 10 are disposed on the upper rail 13 so that the support rollers 27 are brought into contact with the horizontal guide portion 21, while the horizontal rollers 30 are inserted into the vertical guide portion 22.

Then, the horizontal rollers 50 of the lower movement-enabling means 16 are pulled down, together with the movable frame 42, by the grip member 47 of the movable frame 42 on the lower movement-enabling means 16, and, in this state, the horizontal rollers 50 are positioned below the guide portion 23 of the lower rail 14; and then, the movable frame 42 pulled downwardly is released so that the horizontal rollers 50 are allowed to return upwardly together with the movable frame 42 by the force of the springs 48, so that the horizontal rollers 50 are inserted into the guide portion 23.

Then, if the knob 12 on one of said two doors 10 is pulled toward one side thereof, the door bodies 10 are drawn together toward that side, pivotally moving outwards through the links 36 and 52 of the upper and lower movement-enabling means 15 and 16 so as to fold themselves up to that side with the inner-edge portions of the doors 10 projected outwardly, thus exposing the front opening of the body 2.

If, with the doors 10 thus opened, the knob 12 of the other door 10 is pulled toward the other side, then the doors 10 are unfolded under pivotal movement toward the other side or in the closing direction, thus covering the front opening of the body 2.

When mounting the pair of doors 10, the screwed shaft 34 of each upper movement-enabling means 15 is rotated so that, through the internally screw-threaded body 33, the support frame 32 is moved up or down, the height or vertical location of the doors 10 being thus adjusted.

When the doors 10 are maintained in their closed state, the bush 31 of the outer vertical shaft 28 of each upper movement-enabling means 15 is engaged in the recess 66 of the upper stop member 64 and held there by the force of the spring 67, while at the same time, the stop rod 55 of each lower movement-enabling means 16 is engaged in the recess 78 of the lower stop body 76 and held there by the force of the spring 79, so that the upper and lower movement-enabling means 15 and 16 in the respective end portions of the doors 10 are fixed in position, so that the doors are maintained in their closed state.

If the doors 10 are opened by pulling them toward one side thereof, the movement-enabling means 15 and 16 of the door 10 on the other side are moved, whereby, in the upper part of the door section 10, the bush 31 of the outer vertical shaft 28 which has so far been retained in the recess 66 of the stop member 64 disengages thus turning the stop member 64 against the force of the spring 67, while at the same time, the stop rod 55 which has so far been retained in the depression 78 of the stop member 76 disengages therefrom, turning the stop member 76 against the force of the spring 79. In this way, the movement-enabling means 15 and 16 of the door on said side are released from the fixed or retained state and moved.

In this case, the upper and lower movement-enabling means 15 and 16 of the other door 10 are subject to a force when the door opening operation is started, but since the movement-enabling means 15 and 16 are located at the side opposite to the side where the door sections are to be opened, the means 15 and 16 substantially ceases to be subject to this force, the instant the door sections 10 are opened, and thus maintained in a fixed state by the stops 64 and 76 which are biased by the springs 67 and 79, respectively.

Then, if the pair of door sections 10 are closed so that the upper and lower movement-enabling means 15 and 16 on that door section which has been opened are moved back to the respective ends of the upper and lower rails 13 and 14, the bush 31 of the outer vertical shaft 28 of the upper movement-enabling means 15 is led into the recess 66 through the guide portion 65 of the upper stop member 64 on the one hand, while on the other, the stop rod 55 of the lower movement-enabling means 16 is engaged in the recess 78 by means of the guide portion 77 of the lower stop member 76; and the bush 31 and the stop rod 55 thus engaged in the recesses 66 and 78, respectively, are retained by bias forces.

Although, in the hereinbefore described embodiment, the upper and lower stop means 17 and 18 are provided for cooperation with the upper and lower movement-enabling means 15 and 16, respectively, it is alternatively possible to provide stop means only for the upper or only for the lower movement-enabling means 15;16.

The stop means may be of any type which can retain the movement-enabling means under bias forces which produce the same effect as has been hereinbefore described, and therefore, the stop means may also be constructed such that liminar springs for biasing the movement-enabling means are mounted on the inner sides of the rails or ball bearings provided on the movement-enabling means so as to be resiliently extended therefrom and are fitted into recesses provided in the rails.

Furthermore, in the hereinbefore described embodiment, the main body is box-shaped, but the present invention can also be applied to, for example, a closet formed such that doors are mounted on the open front portion of a main body comprising a recess made in a wall of a building, in which case, however, the upper and lower rails 13 and 14 are disposed on the support frame fixed in the recessed wall portion, instead of the top plate 5 and the bottom plate 6.

Furthermore, in the hereinbefore described embodiment, the main body is closed by a pair of door sections but the present invention can also be applied to a particularly wide container in which two or more pairs of such door sections are mounted side-by-side. The door sections can be freely moved to the right and to the left, and therefore, the arrangement is particularly suitable for items of substantial length from side to side to be deposited and removed. In addition, such two or more pairs of doors can also be pivotally coupled together by means of hinges. The folding door assembly according to the present invention can thus consist of more than two pairs of door sections.

Alternatively to the arrangement of the hereinbefore described embodiment, where the rails 13,14 are mounted on upper and lower portions of the structure defining the outer periphery of the front opening of the main body, it is also possible to mount the rails 13,14 on the inner periphery of the structure defining the front opening so that the upper rail is mounted on the upper surface of the bottom panel, while the lower rail is mounted on the under surface of the top panel, and the upper movement-enabling means is mounted in the lower portion of the outer side end of the back surface of each the door section, while the lower movement-enabling means is mounted in the upper portion of the outer side end of the back surface of each door section, so that the door weight is supported by the lower rail. This modified embodiment gives rise to the same advantages as the preferred embodiment described in detail.

Both vertical edges of a pair of doors are retained by stop means, and therefore, by pulling on one of the paired door sections held in a retained state in one or the other direction, the paired door sections are moved in that direction so as to fold up, under pivotal movement, with the hinged inner vertical edge portions thereof extending outwardly. Thus, the paired door sections can be opened in either direction, and, by pulling the other door section in the closing direction, the door sections are unfolded, under pivotal movement, with the hinged inner vertical edge portions thereof progressively flattened towards the opening plane of the container and thus, they can be closed smoothly and infallibly. Accordingly, even if the container assembly according to the present invention is disposed at a corner of a room, the opening/closing operation of the door sections does not interfere with the furniture or other obstruction placed in front of the container, and further, articles can be easily placed in or removed from any part of the internal space of the container. In this way, constructions in accordance with present invention contribute to the enhancement of the applicability and the degree of freedom in use of such container assemblies.

What is claimed is:

1. A container assembly comprising means defining a main body with a front opening, and having upper and lower portions, an upper rail mounted on the said upper portion, a lower rail mounted on the said lower portion, a pair of door sections arranged to close said front opening, hinge means connecting said door sections at adjacent vertical edges thereof, upper movement-enabling means mounted to each of the door sections and movable on the upper rail, lower movement-enabling means mounted to each of the door sections and movable on the lower rail, the movement-enabling means and the hinge means being so arranged that the door sections can fold so that the door sections protrude outwardly of the front opening to enable access to the container, and stop means provided at each end of at least one of said rails, said stop means serving releasably to retain the said movement-enabling means each said stop means comprising a frame secured to the corresponding said rail, a stop member, means mounting the stop member on the frame for horizontal turning motion, said stop member including a tapered guide portion, means defining a recess contiguous with the tapered guide portion, resilient means mounted on the frame of the stop means and biasing the stop member towards the corresponding rail, said movement-enabling means further comprising a shaft-like member extending substantially parallel to plane of the corresponding door section which shaft-like member can engage in the said recess after guidance along the tapered guide portion, the co-operation of the recess and the shaft-like member serving to retain the movement-enabling means on the stop means.

2. A container assembly according to claim 1 wherein said upper rail comprises a plane horizontal guide portion and a channel section portion contiguous and extending parallel to the guide portion, and said upper movement-enabling means comprises rollers each rotatable about a horizontal axis and running on the plane horizontal guide portion and rollers each rotatable about a vertical axis and engaged in the channel section portion.

3. A container assembly according to claim 1 wherein said lower rail comprises an inverted channel section member and the lower movement enabling means comprises rollers each rotatable about a vertical axis and engaged in the inverted channel section member.

4. A container assembly according to claim 1 wherein the resilient means biasing the stop member is a helical compression spring mounted at one end on the said frame of the stop means and at the other end on the stop member.

5. A container assembly according to claim 1 wherein a support block is disposed opposite the recess of the stop member and serves in conjunction with the resilient means of the stop means to co-operate with the recess of the stop member in retaining releasably said shaft-like member of the movement-enabling means in the recess.

* * * * *